US007843146B2

(12) United States Patent
Chang Chien et al.

(10) Patent No.: US 7,843,146 B2
(45) Date of Patent: Nov. 30, 2010

(54) LED DIMMING CONTROL CIRCUIT

(75) Inventors: Shang-Yu Chang Chien, Kaohsiung County (TW); Tien-Tzu Chen, Hsinchu (TW)

(73) Assignee: Global Mixed-mode Technology Inc., Hsinchu (TW)

( * ) Notice: Subject to any disclaimer, the term of this patent is extended or adjusted under 35 U.S.C. 154(b) by 569 days.

(21) Appl. No.: 12/020,585

(22) Filed: Jan. 28, 2008

(65) Prior Publication Data

US 2009/0189546 A1 Jul. 30, 2009

(51) Int. Cl.
*G05F 1/00* (2006.01)

(52) U.S. Cl. ..... 315/291; 315/224; 315/226; 315/307; 315/DIG. 4; 345/82; 345/42; 345/77; 345/212

(58) Field of Classification Search ..... 315/247, 315/240, 241 R, 242, 243, 224–226, 291, 315/297, 307, DIG. 4; 345/39, 42, 46, 77, 345/82, 204, 212
See application file for complete search history.

(56) References Cited

U.S. PATENT DOCUMENTS 5,481,178 A 1/1996 Wilcox et al.
5,705,919 A 1/1998 Wilcox
5,847,554 A 12/1998 Wilcox
5,912,552 A 6/1999 Tateishi
5,929,620 A 7/1999 Dobkin et al.
6,310,469 B1 10/2001 Bentolila et al.
6,366,066 B1 4/2002 Wilcox
6,534,931 B1 * 3/2003 Konopka et al. ..... 315/291
6,987,787 B1 1/2006 Mick
7,145,295 B1 12/2006 Lee et al.
7,321,203 B2 * 1/2008 Marosek ..... 315/247
7,768,212 B2 * 8/2010 Chen et al. ..... 315/225
2006/0097705 A1 5/2006 Cheung et al.
2006/0175986 A1 8/2006 Lee et al.
2010/0090530 A1 * 4/2010 Watanabe ..... 307/37
2010/0213857 A1 * 8/2010 Fan ..... 315/186

* cited by examiner

*Primary Examiner*—Haissa Philogene
(74) *Attorney, Agent, or Firm*—Winston Hsu; Scott Margo

(57) ABSTRACT

A LED dimming control circuit that avoids a higher output voltage than expected is provided. The LED dimming control circuit comprises an inductor, a transistor, a dimming control signal, a feedback signal, a switching control circuit, an error amplifier, and an inverted amplifier. The inductor and the transistor are coupled to a node. The switching control circuit is controlled by the dimming control signal and the feedback signal. The transistor is controlled by the switching control circuit. The output terminal of the error amplifier and the non-inverted input terminal of the error amplifier form a negative feedback path via the inverted amplifier.

12 Claims, 2 Drawing Sheets

LED DIMMING CONTROL CIRCUIT

BACKGROUND OF THE INVENTION

1. Field of the Invention

The present invention relates to a dimming control circuit. More particularly, the present invention relates to a LED dimming control circuit.

2. Description of the Related Art

FIG. 1 is a circuit diagram showing a conventional LED dimming control circuit 100. In the example shown in FIG. 1, the LED dimming control circuit 100 is implemented by a boost-type voltage converter which converts an input voltage $V_{in1}$ into an output voltage $V_{o1}$, so as to drive a LED 19. A switching control circuit 10 comprises a capacitor $C_{11}$, a resistor $R_{11}$, a comparator 13, an oscillating circuit 14, a current-to-voltage converter 15, a latch 16, a current sensing circuit 17, and a driving circuit 18. The connection point of the resistor $R_{12}$ and the cathode terminal of the LED 19 is used to provide a feedback signal $V_{fb1}$. The switching control circuit 10 is used to control the transistor T1 in response to a dimming control signal CN1, the feedback signal $V_{fb1}$, and the current of the inductor L1. The user can adjust the brightness of the LED 19 by changing the dimming control signal CN1. The error amplifier 12 compares the reference voltage $V_{r1}$ and the feedback signal $V_{fb1}$ so as to generate an output current $I_{eo1}$ to the switching control circuit 10. When the dimming control signal CN1 is at a high level, the LED dimming control circuit 100 operates in a normal boost-type mode. The peak current value of the inductor L1 is controlled by the output current $I_{eo1}$. When the dimming control signal CN1 is at a low level, the LED dimming control circuit 100 stops switching. The decrease of the output voltage $V_{o1}$ results in the decrease of the feedback signal $V_{fb1}$ and the increase of the output current $I_{eo1}$. When the dimming control signal CN1 changes from the low level to the high level, the inrush current of the inductor L1 will be large, resulting in a higher output voltage $V_{o1}$ than expected.

SUMMARY OF THE INVENTION

In view of the above-mentioned problems, an object of the present invention is to provide a LED dimming control circuit, capable of reducing the inrush current of the inductor and regulating an expected output voltage.

According to the present invention, the LED dimming control circuit comprises a soft start circuit, an error amplifier, an inverted amplifier, a switching control circuit, an inductor, a transistor, and a diode. The switching control circuit is used to control the transistor in response to a dimming control signal, a feedback signal, and the inductor current. When the dimming control signal is at a high level, the LED dimming control circuit operates in a normal current mode. When the dimming control signal is at a low level, the LED dimming control circuit stops switching, resulting in the decrease of the feedback signal. Since the output terminal of the error amplifier and the non-inverted input terminal of the error amplifier form a negative feedback path via the inverted amplifier, the voltage of the non-inverted input terminal of the error amplifier follows the feedback signal to be decreased accordingly. When the dimming control signal changes from the low level to the high level, the feedback signal will follow the voltage of the non-inverted input terminal of the error amplifier to be increased gradually, resulting that the output current of the error amplifier will not be too large. Therefore, the inrush current of the inductor will not be too large, resulting that a higher output voltage than expected can be avoided.

BRIEF DESCRIPTION OF THE DRAWINGS

The above-mentioned and other objects, features, and advantages of the present invention will become apparent with reference to the following descriptions and accompanying drawings, wherein.

DETAILED DESCRIPTION OF THE INVENTION

Figure 1:
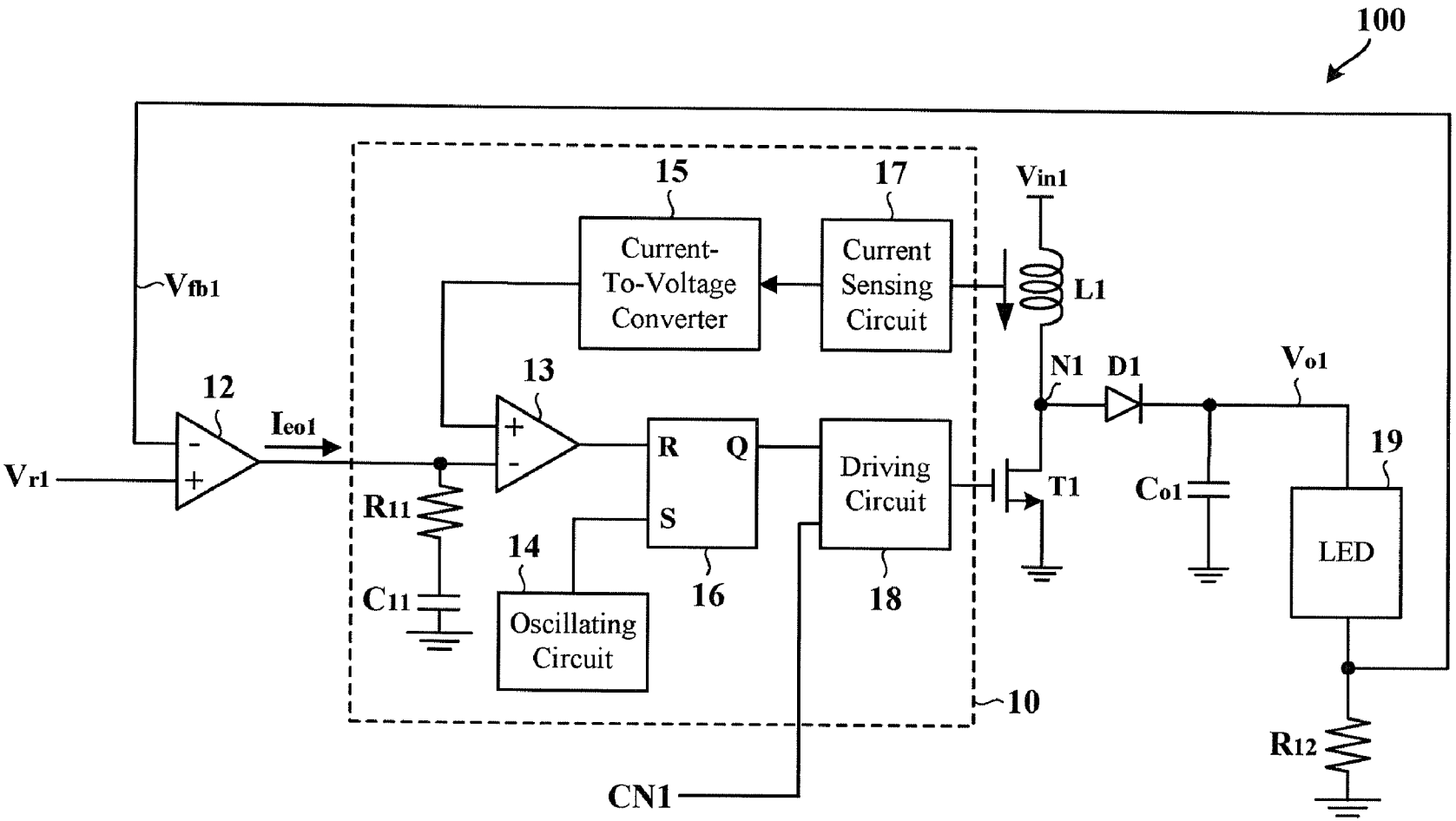
FIG. 1 (Prior Art)
FIG. 1 is a circuit diagram showing a conventional LED dimming control circuit.

A preferred embodiment according to the present invention will be described in detail with reference to the drawing.

Figure 2:
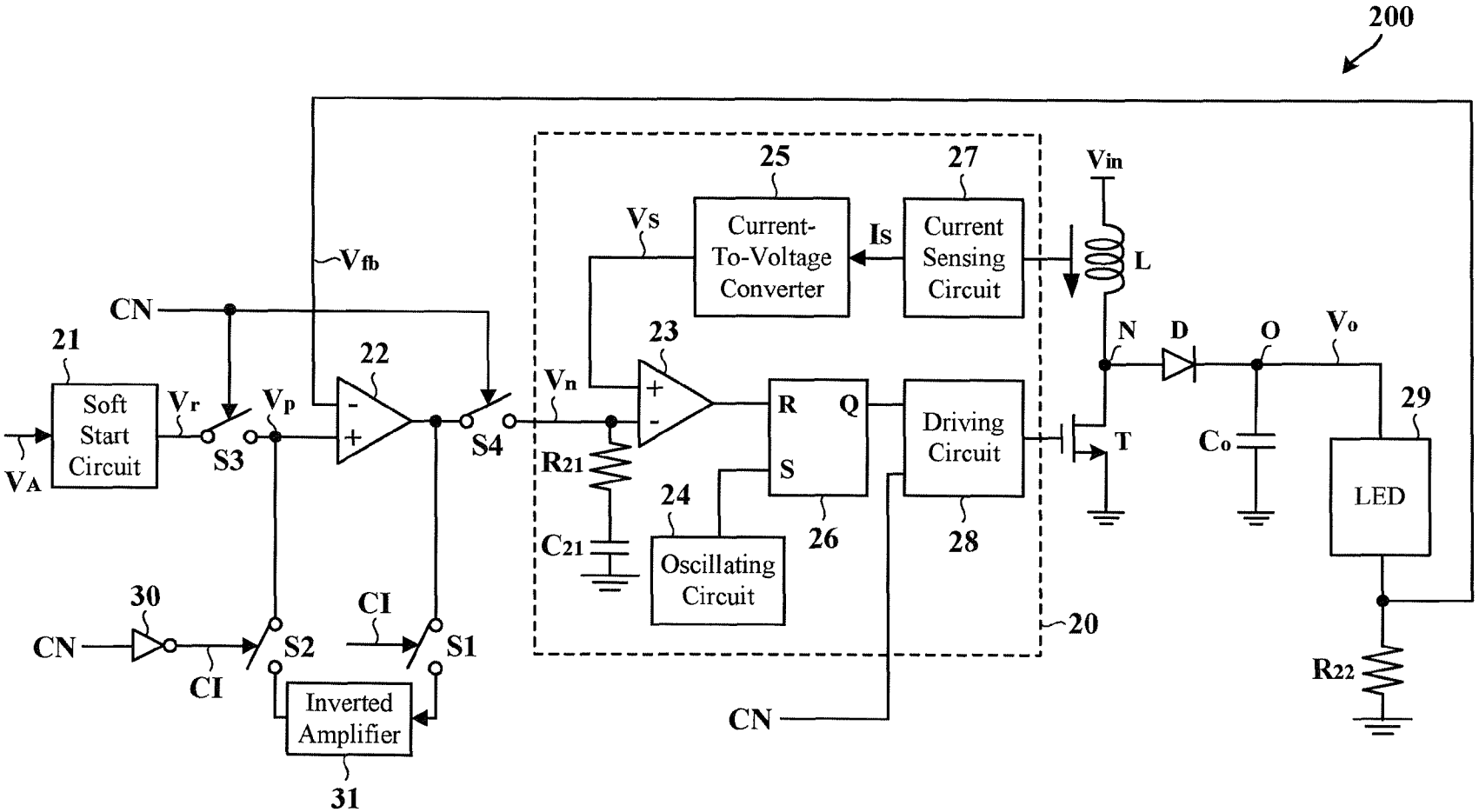
FIG. 2 is a circuit diagram showing a LED dimming control circuit according to the present invention.

FIG. 2 is a circuit diagram showing a LED dimming control circuit 200 according to the present invention. In the example shown in FIG. 2, the LED dimming control circuit 200 is implemented by a boost-type voltage converter which converts an input voltage $V_{in}$ into an output voltage $V_o$, so as to drive a LED 29. The LED dimming control circuit 200 comprises a soft start circuit 21, an error amplifier 22, switches S1 to S4, an inverter 30, an inverted amplifier 31, a switching control circuit 20, an inductor L, a transistor T, a diode D, a resistor $R_{22}$, and an output capacitor $C_o$. The inductor L, the transistor T, and the diode D are commonly coupled to a node N. The anode terminal of the LED 29, the diode D, and the output capacitor $C_o$ are commonly coupled to a node O. The connection point of the resistor $R_{22}$ and the cathode terminal of the LED 29 is used to provide a feedback signal $V_{fb}$, where the feedback signal $V_{fb}$ is coupled to the inverted input terminal of the error amplifier 22. The switching control circuit 20 is used to control the transistor T in response to a dimming control signal CN, the feedback signal $V_{fb}$, and the current of the inductor L. The user can adjust the brightness of the LED 29 by changing the dimming control signal CN. In addition, the switching control circuit 20 further comprises a capacitor $C_{21}$, a resistor $R_{21}$, a comparator 23, an oscillating circuit 24, a current-to-voltage converter 25, a latch 26, a current sensing circuit 27, and a driving circuit 28. Switches S1 and S2 are controlled by the signal CI, which is the inverted signal of the dimming control signal CN. Switches S3 and S4 are controlled by the dimming control signal CN. The switch S1 is coupled between the output terminal of the error amplifier 22 and the input terminal of the inverted amplifier 31. The switch S2 is coupled between the non-inverted input terminal of the error amplifier 22 and the output terminal of the inverted amplifier 31. The switch S3 is coupled between the output terminal of the soft start circuit 21 and the non-inverted input terminal of the error amplifier 22. The switch S4 is coupled between the output terminal of the error amplifier 22 and the inverted input terminal of the comparator 23.

When the dimming control signal CN is at a high level, switches S1 and S2 are turned OFF and switches S3 and S4 are turned ON. The LED dimming control circuit 200 operates in a normal current mode. The driving circuit 28 is used to control the transistor T based on the output signal of the latch 26. The error amplifier 22 compares the voltage $V_p$ of the non-inverted input terminal and the feedback signal $V_{fb}$ so as to generate an output current to charge the capacitor $C_{21}$, where the resistor $R_{21}$ and the capacitor $C_{21}$ form a compensation circuit. The oscillating circuit 24 applies a pulse signal with a fixed frequency to the set terminal of the latch 26 so as to make the transistor T conductive. Once the transistor T begins to conduct, the current of the inductor L will be increased accordingly. Furthermore, the current sensing circuit 27 generates a current $I_S$ to the current-to-voltage converter 25, where the current $I_S$ is proportional to the current of the inductor L. The current-to-voltage converter 25 receives the current $I_S$ to generate an output voltage $V_S$ to the non-inverted input terminal of the comparator 23. When the output voltage VS exceeds the voltage $V_n$ of the inverted input terminal of the comparator 23, the comparator 23 will trigger the reset terminal of the latch 26 to make the transistor T nonconductive.

When the dimming control signal CN is at a low level, the LED dimming control circuit 200 stops switching. Therefore, the output voltage $V_o$ decreases, resulting in the decrease of the feedback signal $V_{fb}$. At this moment switches S1 and S2 are turned ON and switches S3 and S4 are turned OFF. The voltage $V_p$ is no longer controlled by the soft start circuit 31. Since the output terminal of the error amplifier 22 and the non-inverted input terminal of the error amplifier 22 form a unit-gain negative feedback path via the inverted amplifier 31, the voltage $V_p$ will follow the feedback signal $V_{fb}$ to be decreased accordingly.

When the dimming control signal CN changes from the low level to the high level, the reference voltage $V_r$ outputted from the soft start circuit 21 increases gradually. When the reference voltage $V_r$ increases to a pre-determined voltage $V_A$, the reference voltage $V_r$ will be kept at the pre-determined voltage $V_A$ hereafter. Since the switch S3 is turned ON, the voltage $V_p$ is equal to the reference voltage $V_r$. Under such circumstance the LED dimming control circuit 200 operates in a normal current mode. Therefore, the feedback signal $V_{fb}$ will follow the voltage $V_p$ to be increased gradually, resulting that the output current of the error amplifier 22 will not be too large. So, the inrush current of the inductor L will not be too large, resulting that a higher output voltage $V_o$ than expected can be avoided.

While the invention has been described by a preferred embodiment, it is to be understood that the invention is not limited to the disclosed embodiment. On the contrary, it is intended to cover various modifications. Therefore, the scope of the appended claims should be accorded the broadest interpretation so as to encompass all such modifications.

What is claimed is:

1. A dimming control circuit used to drive a LED comprising:

an inductor, wherein a first current flows through the inductor;

a transistor, wherein the inductor and the transistor are coupled to a node;

a dimming control signal;

a feedback signal;

a switching control circuit, wherein the switching control circuit is controlled by the dimming control signal and the feedback signal, and the transistor is controlled by the switching control circuit;

an error amplifier comprising a first non-inverted input terminal, a first inverted input terminal, and a first output terminal; and an inverted amplifier comprising a second input terminal and a second output terminal, wherein:

the first output terminal and the first non-inverted input terminal form a negative feedback path via the inverted amplifier.

2. The dimming control circuit of claim 1 further comprising a diode, wherein a terminal of the diode is coupled to the node.

3. The dimming control circuit of claim 1 further comprising:

a first switch coupled between the first output terminal and the second input terminal; and a second switch coupled between the first non-inverted input terminal and the second output terminal.

4. The dimming control circuit of claim 3, wherein the first switch and the second switch are controlled by an inverted signal of the dimming control signal.

5. The dimming control circuit of claim 4 further comprising:

a third switch; and a fourth switch, wherein:

the third switch and the fourth switch are controlled by the dimming control signal.

6. The dimming control circuit of claim 5, wherein the switching control circuit comprising:

a current sensing circuit used to provide a second current, the second current being proportional to the first current;

a comparator comprising a third non-inverted input terminal, a third inverted input terminal, and a third output terminal, wherein the third inverted input terminal is coupled to a compensation circuit;

a current-to-voltage converter receiving the second current so as to generate a first voltage to the third non-inverted input terminal;

an oscillating circuit comprising a fourth output terminal;

a latch comprising a reset terminal, a set terminal, and a first output signal, wherein the reset terminal is coupled to the third output terminal and the set terminal is coupled to the fourth output terminal; and a driving circuit used to control the transistor based on the dimming control signal and the first output signal.

7. The dimming control circuit of claim 1, wherein the feedback signal is coupled to a cathode terminal of the LED.

8. The dimming control circuit of claim 6 further comprising a soft start circuit, wherein the soft start circuit is used to generate a reference voltage based on a pre-determined voltage, and the soft start circuit comprises a fifth output terminal, wherein the voltage of the fifth output terminal is equal to the reference voltage.

9. The dimming control circuit of claim 8, wherein the third switch are coupled between the fifth output terminal and the first non-inverted input terminal, and the fourth switch are coupled between the first output terminal and the third inverted input terminal.

10. The dimming control circuit of claim 2, wherein an anode terminal of the LED is coupled to the diode.

11. The dimming control circuit of claim 1, wherein the feedback signal is coupled to the first inverted input terminal.

12. The dimming control circuit of claim 1, wherein the switching control circuit is further controlled by the first current.

* * * * *